United States Patent [19]

Barber

[11] Patent Number: 4,961,243

[45] Date of Patent: Oct. 9, 1990

[54] CARPET CLEANING PAD

[75] Inventor: John E. Barber, New Hope, Pa.

[73] Assignee: Stockwell Group, Inc., Middleburg, Va.

[21] Appl. No.: 354,127

[22] Filed: May 18, 1989

[51] Int. Cl.[5] ..... A47L 11/14

[52] U.S. Cl. ..... 15/230; 15/4; 15/98; 15/230.16; 15/49.1; 428/88; 428/97

[58] Field of Search ..... 15/49 R, 4, 50 R, 50 A, 15/98, 230, 230.12, 230.13, 230.16, 230.17, 230.18, 230.19, 385, 230.14; 428/88, 97

[56] References Cited

U.S. PATENT DOCUMENTS 4,418,438 12/1983 Cutler ..... 15/230

*Primary Examiner*—Edward L. Roberts

*Attorney, Agent, or Firm*—Spencer & Frank

[57] ABSTRACT

A carpet cleaning pad which includes a horizontal disc made of a base material, a primary layer of a blended yarn tufted to the base material by tufting, and one or more radial strips of fibrous bristles which are attached to said base material. The blended yarn is made by weaving together three or more different individual yarns including one yarn made of acrylic fibers or wool fibers.

19 Claims, 1 Drawing Sheet

CARPET CLEANING PAD

FIELD OF THE INVENTION

The invention relates to cleaning pads and particularly to the pads which are used in conjunction with rotary floor machines for cleaning carpets.

TECHNOLOGY REVIEW

The cleaning pads which are generally in use are more or less of a mop-like or shag-like consistency in that the surface which bears on the floor is soft and yielding. They can be described as having a soft, shaggy surface and not a firm surface. A disadvantage of such conventional pads is that they lack the aggressive stripping and scrubbing fiber which are necessary to achieve an effective cleaning action. Such conventional pads are about as effective as using a conventional mop over the surface of a rug. No worthwhile deep cleaning action is achieved.

Some other cleaning pads have been formed with firm surfaces to bear on the surface to be cleaned and these pads are made by tightly looping strands of strong synthetic material through a base sheet. The resulting pad is much like a hooked rug as its working surface is quite firm. Such a pad has the advantage of actively cleaning the carpet and picking up in the pad a considerable amount of the dirt which was lodged deep in the carpet or rug.

Still other cleaning pads have included strips of fibers which are much like the consistency of conventional hairbrushes. Such fibers possess an adequate scrubbing action but they lack the feature of picking up and retaining the dirt which is released from the rug or carpet. These strips or bands of fibers are radially disposed or approximately so.

An attempt to make a cleaning pad which scrubs and retains dirt is described in U.S. Pat. No. 4,418,438. This patent describes a floor cleaning pad which is basically firm and fabricated like a hooked rug and has radial srips of brushes and also arcuate strips of fibers close to the circular edge. It has been noted that a deficiency of this pad is that dirt is not fully retained within the pad, that is dirt is transferred from the pad to surfaces the pad rubs up against. It would be desirable to design a cleaning pad with good scrubbing properties that more fully retains dirt within the pad.

SUMMARY OF THE INVENTION

It is therefore an object of the present invention to provide a cleaning pad with good scrubbing properties that more fully retains dirt within the pad.

The present invention provides a carpet cleaning pad which includes a horizontal disc made of a base material, a primary layer of a blended yarn tufted to the base material by tufting, and one or more radial portions or strips of fibrous bristles which are attached to said base material. The blended yarn is made by weaving together three or more individual yarns including one yarn made of acrylic fibers, wool fibers or polyester fibers.

DESCRIPTION OF THE PREFERRED EMBODIMENTS

Figure 1:
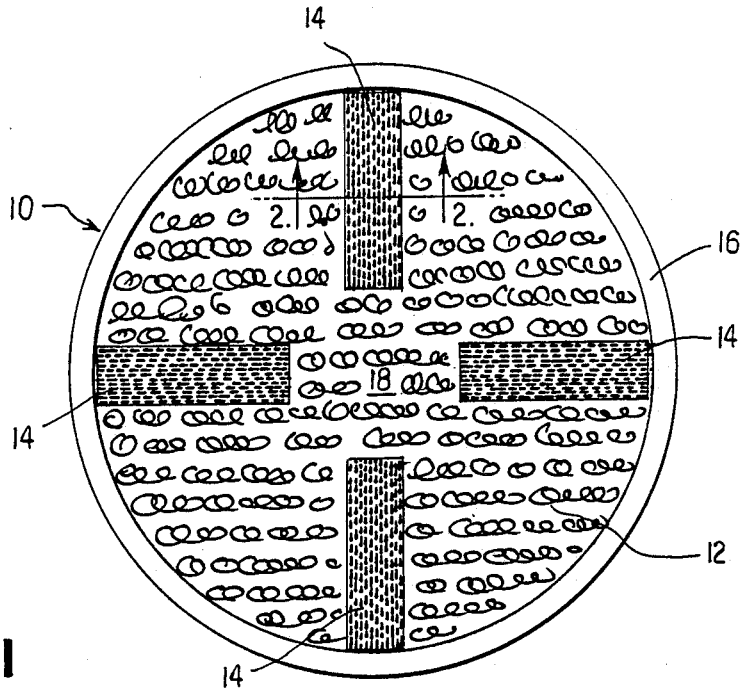
FIG. 1 shows the underside or working side of the pad.
Figure 2:
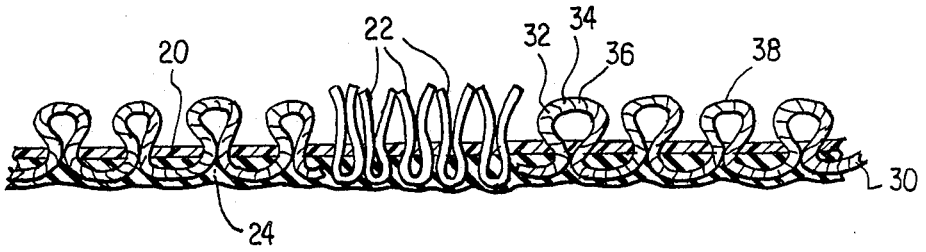
FIG. 2 shows is a section on the line 2—2 of FIG. 1.

The pad 10 is of a disc or circular shape and has base sheet of material 20 which is preferably made of a synthetic fabric such as a Sub-strat-brand modular rayon drill. A typical base material has a "basket-weave" design and has 21 pick ends per inch in one direction and 19 pick ends per inch in the other direction. To achieve good wearability, the base material is preferably at least 2500 denier in weight. The base material is preferably made of synthetic fibers to increase shrink resistance upon washing. Suitable synthetic fibers from which the base material may be woven include rayon, or other synthetic fibers such as polyolefins, polypropylene, nylon, etc., which are resistant to shrinking when exposed to hot water or heat.

A primary layer 12 of a blended yarn 30 is tufted to the base material 20 by conventional tufting machines such as a Tuftco Model 204 (manufactured by Tuftco Corp. of Chattanooga, Tenn.) to form tufts 38. The blended yarn 30 is made up of at least three different individual yarns 32, 34 and 36 which are woven together by conventional yarn weaving means. While the order of the yarns is not critical to the invention, for the sake of discussion, yarn 32 will represent an acrylic or a wool yarn, yarn 34 will represent a nylon yarn and yarn 36 will represent a rayon yarn, unless otherwise indicated.

An important feature of the invention is it superior dirt retention which results from combining an acrylic, wool or polyester yarn 32 with two other yarns 34 and 36. With a proper blending of yarns in the blended yarn 30, a pad 10 can be produced which will not transfer retained dirt, even after repeated rubbings on a surface such as a carpet or a piece of clothing. The choice of an acrylic or wool yarn will depend on such things as cost and the particular properties desired in the finished pad. For instance, acrylic, a synthetic fiber, has better shrink resistance than wool, a natural fiber, which may be important in situations when the pad is to be washed repeatedly. Both acrylic and wool fibers have the property of increasing the ability of the pad 10 to pick up and retain dirt. Acrylic fibers also give the pad a good handfeel. However, a disadvantage of acrylic yarn is that it does not have particularly good wearability, so other types of yarn normally make up the bulk of the blended yarn. The proportion of acrylic or wool yarn in the blended yarn is preferably about 5 to 60%.

A polyester yarn may be used in place of the acrylic or wool yarn. However, because polyester fibers do not retain soil as well as acrylic or wool fibers, the proportion of polyester needed in the combined yarn to achieve the same cleaning effect as a combined yarn including acrylic or wool is significantly greater.

The nylon yarn 34 may be considered the backbone of the blended yarn 30 because it has good durability. Other fibrous yarns with good wearability may used in place of nylon, but nylon is a preferred durable yarn, because it is a synthetic and therefore exhibits good shrink resistance upon upon exposure to heat or hot water. The proportion of nylon in the blended yarn is preferably about 30 to 70%.

The rayon yarn 36 is preferably used in the blended yarn 30 to give the pad good moisture retention. In addition to helping pick up and retain dirt, the rayon in the pad also helps dry the carpet being cleaned. Further, rayon also has the ability to lift detergent residues from the carpet being cleaned. However, although its wearability is better than that of acrylic yarn, rayon does not have the durability of nylon. For this reason, nylon may be considered the backbone of the blended yarn, even though rayon has better absorption properties than nylon. While natural fibers with properties similar to those of rayon may be used in the blended yarn, because rayon is a synthetic fiber, it is a preferred fiber because it exhibits good shrink resistance when exposed to heat or hot water. The proportion of rayon in the blended yarn is preferably about 5 to 60%.

It has been found that using a three-fiber blend yarn which includes acrylic or wool provides better capillary attraction, i.e. better attraction of dirt into the pad 10, than single fiber yarns or two-fiber yarns. Preferably, the fibers are not dyed, because dying the fibers normally decreases their cleaning ability.

The pad 10 also includes one or more radial portions or stripes 14 made of fibrous bristles 22. For the purposes of the present invention, the term "radial portion" refers to a stripe of bristles which extends from a point at or near the center of the pad towards the edge of the pad. While such "radial portions" include the rectangular portions shown, they could also include stripes which are in the shapes of squares, curves, letters, etc. Preferably, the fibrous bristles are made of polypropylene fibers in the form of a cut pile. While the bristles 22 may be the only material in the stripe areas 14, preferably the bristles 22 are formed by overtufting a fibrillate polypropylene yarn over the primary layer 12 and then cutting off the top of the tufted polypropylene loops to form a cut pile. The polypropylene stripes have the property of causing a small amount of heat to develop in the pad 10 as it is run over a carpet. As the pad heats up, the fibers in the pad appear to open up and are found to more readily accept the dirt in the carpet, e.g. through capillary attraction. While polypropylene is the preferred material used in the bristles, other materials with similar properties could also be used. If desired, the polypropylene may be dyed.

There may for example be four radial stripes in the shape of a cross with a central region 18 of the primary layer 12 which separates opposing stripes. The polypropylene stripes do not necessarily extend into the central region, because less pressure is exerted by the pad 10 in the middle during cleaning. However, other radial stripe designs could also be used. The maximum area of the stripes should be limited to not more than about 30% of the surface area of the pad, preferably about 10 to 20% of the surface area of the pad. A pad with too much polypropylene in it may generate too much heat during use and interfere with the cleaning action of the pad, so it is desirable to spread out the polypropylene stripes. It is also desirable to spread out the polypropylene stripes 14 because they increase the weight of the pad 10.

Preferably, the cut piles 22 are at least about 3 mm (⅛") inch higher than the height of the primary layer loops 38. Most preferably, the cut piles 22 are about 13 mm (½") high and the primary layer loops 38 are about 10 mm (⅜") high.

A rubber backing 24 made of natural rubber or latex may be applied to the back of the pad 10 to increase stability of the pad 10 and hold in the tufted yarn 30. The backing can be set by applying rubber to the back of the pad and curing the rubber for about 1 hour at about 127° to about 138° C. (260° to 280° F.). Other materials may be used as the backing, but preferred materials are water resistant to stand up to repeated washings.

The edge of the pad may be sewn by conventional means to form a border 16. Preferably, the edge is sewn by an overedging technique to prevent the pad 10 from unravelling. Alternatively, the pad 10 could have a fringe (not shown) sewn onto it for increasing the ability of the pad to clean near walls and at the edges of carpets.

Preferably, synthetic materials are used throughout the pad 10 to increase its resistance to shrinking upon being exposed to heat or hot water. The use of synthetics also prevents shedding of the pad 10 on the material being cleaned.

It is understood that various other modifications will be apparent to and can readily be made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A carpet cleaning pad for rotary floor cleaning machines, comprising:

a horizontal disc comprising a base material;

a primary layer comprising a blended yarn attached to said base material by tufting, said blended yarn including at least three different individual yarns wherein at least one of said individual yarns comprises fibers selected from the group consisting of acrylic fibers, wool fibers and polyester fibers; and at least one radial portion of fibrous bristles attached to said base material, said fibrous bristles extending substantially vertically from said base material.

2. A carpet cleaning pad according to claim 1, wherein at least one of said yarns comprises nylon fibers.

3. A carpet cleaning pad according to claim 1, wherein at least one of said yarns comprises rayon fibers.

4. A carpet cleaning pad according to claim 1, wherein at least one of said yarns comprises acrylic fibers.

5. A carpet cleaning pad according to claim 4, wherein said acrylic fibers comprise about 5 to 60% of said blended yarn.

6. A carpet cleaning pad according to claim 1, wherein at least one of said yarns comprises wool fibers.

7. A carpet cleaning pad according to claim 6, wherein said wool fibers comprise about 5 to 60% of said blended yarn.

8. A carpet cleaning pad according to claim 1, wherein said blended yarn is comprised of about 30 to 70% nylon fibers, about 5 to 60% rayon fibers and about 5 to 60% acrylic fibers.

9. A carpet cleaning pad according to claim 1, wherein said blended yarn is comprised of about 30 to 70% nylon fibers, about 5 to 60% rayon fibers and about 5 to 60% wool fibers.

10. A carpet cleaing pad according to claim 1, wherein said at least one radial portion comprises four radial strips in a cross shape.

11. A carpet cleaning pad according to claim 1, wherein each said radial strip is separated from an opposing radial strip by a central region of blended yarn.

12. A carpet cleaning pad according to claim 1, wherein said fibrous bristles comprise polypropylene.

13. A carpet cleaning pad according to claim 12, wherein said fibrous bristles comprise about 10 to 20% of the surface area of said pad.

14. A carpet cleaning pad according to claim 1, wherein said fibrous bristles comprise a cut pile.

15. A carpet cleaning pad according to claim 1, wherein said at least one radial strip comprises cut pile, said primary layer comprises tufted loops, and said cut pile is at least about 3 mm higher than said tufted loops.

16. A carpet cleaning pad according to claim 15, wherein said primary layer comprises about 3 mm high tufted loops and said at least one radial strip comprises about 13 mm high cut pile.

17. A carpet cleaning pad according to claim 1, wherein said base material comprises a modular rayon drill.

18. A carpet cleaning pad according to claim 17, wherein said modular rayon drill is at least 2500 denier.

19. A carpet cleaning pad according to claim 1 further comprising a rubber backing deposited on the side of said pad opposite to the side from which said fibrous bristles extend.

* * * * *